United States Patent [19]

Ogawa et al.

[11] Patent Number: 4,520,623

[45] Date of Patent: Jun. 4, 1985

[54] ACTIVATED CARBON FIBER SPUN YARN

[75] Inventors: Hiroyasu Ogawa; Kazuo Izumi; Kenji Shimazaki, all of Shizuoka, Japan

[73] Assignee: Toho Beslon Co., Ltd., Tokyo, Japan

[21] Appl. No.: 514,898

[22] Filed: Jul. 18, 1983

[30] Foreign Application Priority Data

Jul. 17, 1982 [JP] Japan ..... 57-123784

[51] Int. Cl.[3] ..... D02G 3/02

[52] U.S. Cl. ..... 57/236; 57/200; 57/243; 57/246; 57/252; 57/255; 57/210; 423/447.2; 428/367

[58] Field of Search ..... 428/373, 367, 359; 8/115.5; 57/243, 200, 252, 255, 246, 236, 210; 423/447.1, 447.2, 447.5, 447.7

[56] References Cited

U.S. PATENT DOCUMENTS 3,769,144 10/1973 Economy et al. ..... 428/359 X
4,304,746 12/1981 Yamada et al. ..... 423/447.2
4,457,345 7/1984 von Blucher et al. ..... 57/252

*Primary Examiner*—Lorraine T. Kendell
*Attorney, Agent, or Firm*—Sughrue, Mion, Zinn, Macpeak & Seas

[57] ABSTRACT

An activated carbon fiber spun yarn having excellent workability and adsorptive property is disclosed. The activated carbon fiber spun yarn comprising activated carbon fibers having a specific surface area of 500 to 1,500 $m^2/g$, a ductility of at least 0.5%, and a tensile strength of at least 10 $kg/mm^2$ and derived from acrylonitrile-based fibers. The spun yarn has a twist coefficient of 30 to 60.

14 Claims, No Drawings

ACTIVATED CARBON FIBER SPUN YARN

FIELD OF THE INVENTION

This invention relates to a spun yarn of activated carbon fibers (hereinafter, referred to as "ACF"), and more particularly to an ACF spun yarn having excellent workability and adsorptive property.

BACKGROUND OF THE INVENTION

Recently, fibrous activated carbon, i.e., ACF has been developed as an adsorbent for powdery or granular activated carbon and is used as felts, papers, nonwoven fabrics, and other fabricated structures. It is known that since ACF is in a fibrous state, ACF is fabricated into textiles (see, U.S. Pat. Nos. 3,256,206 and 3,769,144).

However, conventional ACF textiles are very brittle and also, conventional spun yarns have low ductility and are brittle particularly in the case of ACF spun yarns derived from rayon or phenol resin. The ACF spun yarns are poor in workability and it is difficult to fabricate the conventional ACF spun yarns into fabricated yarns such as core yarns and textiles. Thus, if ACF spun yarns having excellent strength and workability are developed, fabricated yarns, textiles, knittings, etc., could be easily produced from the ACF spun yarns. Accordingly, it would be expected that the applicable range of ACF would be greatly enlarged.

SUMMARY OF THE INVENTION

An object of the present invention is to provide spun yarns having excellent workability and adsorptive property.

The inventors have discovered that an ACF spun yarn composed of ACF having specific properties derived from acrylonitrile-based fibers, and having a specific twist coefficient meets the above-described object of this invention.

The ACF spun yarn of the present invention is composed of ACF derived from acrylonitrile-based fibers and having a specific surface area of 500 to 1,500 $m^2/g$, a ductility of at least 0.5%, and a tensile strength of at least 10 $kg/mm^2$, and the ACF spun yarn has a twist coefficient of 30 to 60.

DETAILED DESCRIPTION OF THE INVENTION

The ACF spun yarn of this invention as described above is excellent in workability, whereby when the yarn is unwound at weaving and fed to a roller during the production of a core yarn, the yarn can be smoothly run at a yarn speed of higher than 2.0 meters/sec. without causing breakage. Furthermore, the ACF spun yarn of this invention also has excellent in adsorptive property, whereby the textiles, etc., obtained by the fabrication of the yarn can be suitably used as adsorbent.

ACF in this invention has a specific surface area of 500 to 1,500 $m^2/g$, preferably 700 to 1,400 $m^2/g$, a ductility of at least 0.5%, preferably higher than 1%, and a tensile strength of at least 10 $kg/mm^2$, preferably higher than 20 $kg/mm^2$ and is derived by subjecting acrylonitrile-based fibers to oxidation and activation treatment.

The acrylonitrile-based fibers used in this invention are fibers obtained from a homopolymer of acrylonitrile or a copolymer containing at least 60% by weight, preferably 80 to 98% by weight of acrylonitrile. Examples of comonomers used for forming the copolymers of acrylonitrile are acrylic acid, methacrylic acid, sulfonic acid, the salts of these acids, acid chlorides, acid amides, N-substituted derivatives of vinylamide, vinyl chloride, vinylidene chloride, $\alpha$-chloroacrylonitrile, vinylpyridines, vinylbenzenesulfonic acid, vinylsulfornic acid, and the alkaline earth metal salts of them. Furthermore, fibers obtained from a denaturated polymer prepared by a partial hydrolysis of an acrylonitrile polymer or a mixture of an acrylonitrile polymer and an acrylonitrile copolymer may be used as the acrylonitrile-based fibers in this invention.

The acrylonitrile-based fibers are produced by spinning using various organic solvents and inorganic solvents. When using an inorganic solvent, the use of a concentrated solution of zinc chloride is preferred because when zinc chloride remains in the fibers it accelerates the oxidation and activation of the fibers.

There is no particular restriction on the size of the acrylonitrile-based fibers but fibers having a size of 0.5 to 7 deniers, in particular 0.7 to 3 deniers are preferred. If the size of the fibers is finer than 0.5 denier, the fiber strength is low and in particular, at the activation and the fabrication of the fibers, the occurrence of cutting of the ACF yarn and fluff is increased. On the other hand, if the size of the fibers is thicker than 7 deniers, spinning of the oxidized yarn becomes more difficult. In other words, the oxidized yarn for obtaining the ACF yarn having a desired twist coefficient is not obtained and further the activation yield and the adsorption speed of the yarn are reduced.

The oxidation treatment of the acrylonitrile fibers is performed at 200° to 400° C., preferably at 225° to 350° C. It is preferable to apply a tension to the fibers during the oxidation treatment of the fibers so that the shrinkage of the fibers at the oxidation temperature becomes 70 to 90% of the free shrinkage thereof during the oxidation treatment at the temperature. If the value is lower than 70%, the tow is liable to be cut, while if the value is over 90%, the fibers tend to have reduce mechanical properties and become brittle during the activation step of the fibers. In the present invention, the free shrinkage is defined as the ratio of the shrinked length of the fiber to the length of the fiber before heat treatment when the fiber is subjected to a thermal shrinkage at a definite temperature while applying a load of 1 mg/d to the fiber.

The medium used for the oxidation treatment of the fibers may be the same medium used in a conventional method for producing ACF. That is, a mixed gas of oxygen and an inert gas such as nitrogen, argon, helium, etc., which is composed of 0.2 to 35% by volume, preferably 20 to 25% by volume of oxygen is used.

The time required for the oxidation treatment depends upon the kind of acrylonitrile-based fibers, that is, the kind and the amount of the comonomer employed for producing the acrylonitrile copolymer and the kind of a medium used for the oxidation treatment but time may be shorter as the oxidation temperature is higher. Usually, the oxidation time is 0.5 to 30 hours, preferably 1.0 to 10 hours and the oxidation of the fibers is performed until the amount of bonded oxygen becomes higher than 15% by weight. If the amount of bonded oxygen is lower than 15% by weight, cutting of fibers occurs at the activation of fibers to reduce the activation yield. The amount of bonded oxygen is preferably higher than 16.5% and can be increased to about 23 to 25%.

Now, the amount of bonded oxygen is obtained by the following equation:

$$\text{Amount of bonded oxygen (\% by weight)} = \frac{\left(\begin{matrix}\text{Total weight}\\\text{of sample}\end{matrix}\right) - \left(\begin{matrix}\text{Weight}\\\text{of ash}\end{matrix}\right) - \left(\begin{matrix}\text{Total weight}\\\text{of C, H, N}\end{matrix}\right)}{\left(\begin{matrix}\text{Total weight}\\\text{of sample}\end{matrix}\right) - \left(\begin{matrix}\text{Weight}\\\text{of ash}\end{matrix}\right)} \times 100$$

It is preferred that the oxidized fibers to be subjected to activation contain a phosphorus compound as shown below in an amount of 0.005 to 1% by weight, preferably 0.01 to 0.2% by weight.

By adding the phosphorus compound, the activation yield at the activation treatment of the fibers can be increased as well as the strength, abrasion resistance and adsorptive property of ACF can be improved.

Examples of preferred phosphorus compounds usable in this invention include inorganic phosphorus compounds such as phosphoric acid, methaphosphoric acid, pyrophosphoric acid, phosphorus acid, and salts (ammonium, calcium, and magnesium salts) of such acids and organic phosphorus compounds such as substituted or unsubstituted alkyl, substituted or unsubstituted aryl phosphonates, phosphates, and phosphites. Of the organic compounds described above, particularly preferred are organic phosphorus compounds having an unsubstituted alkyl group of 1 to 16 carbon atoms or an alkyl group of 1 to 16 carbon atoms substituted with a chlorine atom, bromine atom, or hydroxyl group, and organic phosphorus compounds having a phenyl group, a substituted phenyl group with a phenyl group, alkyl group of 1 to 16 carbon atoms, halogen atom, hydroxyl group, or ester group of $COOR_1$ ($R_1$ being an alkyl group of 1 to 16 carbon atoms or an aryl group such as, for example, a phneyl group). Concrete examples of such particularly preferred organic phosphorus compounds are n-butyl-bis(2-chloroethyl)-phosphate and tris-chloroethyl phosphate.

The ratio of the number of ACFs which are hollow (which can be observed by enlarging the cross section of the fiber 200 times) to the total number of ACFs is preferably less than 30% to obtain the above-described desired characteristics. The ratio can be controlled by controlling the core ratio of the oxidized fiber to be less than 18%. The core ratio can be reduced by using a phosphoric compound and/or by controlling the oxidizing temperature to be within the range of 225° to 350° C.

The expression "core ratio" of fiber as used in the present invention represents the area percentage of the cross section of core to the cross section of fiber as given by the following formula. Specifically, this percentage is obtained by cutting a section 3μ in thickness from a sample fiber, photomicrographing the section (by 400 magnifications), measuring the core and fiber diameters on the photomicrograph, and calculating the ratio as indicated by the formula. In the present disclosure, the core ratio is reported as an average obtained of a total of 20 specimens of a sample fiber.

$$\text{Core ratio (\%)} = \frac{\left(\begin{matrix}\text{Cross section}\\\text{of core}\end{matrix}\right)}{\left(\begin{matrix}\text{Cross section}\\\text{of fiber}\end{matrix}\right)} \times 100 = \frac{\left(\begin{matrix}\text{Diameter}\\\text{of core}\end{matrix}\right)^2}{\left(\begin{matrix}\text{Diameter}\\\text{of fiber}\end{matrix}\right)^2} \times 100$$

As the activation method, a continuous method is desired and in this case, since as the temperature is higher, the fibers are introduced at higher speed, air is carried on the fibers when introducing the oxidized fibers into the activation zone to cause a possibility of forming activation spots.

In order to avoide the occurrence of the aforesaid fault, it is preferred to maintain the pressure in the furnace in the range of 0.002 to 2 kg/cm$^2$ (in addition to atmosphere pressure) by controlling the extent of the slit opening in the inlet portion for the fibers and by controlling the introduction of a nitrogen gas or steam into the activation zone.

If the pressure in the furnace is lower than 0.002 kg/cm$^2$, or is negative pressure, activation spots may form on the ACF or the fibers may become ash, and thus the production of good products becomes impossible.

On the other hand, if the pressure in the furnace is too high, steam is liable to condense at the portion between the slit and a low temperature portion, whereby the slit portion is clogged to form activation spots.

Examples of the activation gas in the activation treatment are active gases such as steam, carbon monoxide, carbon dioxide gas, etc. They may be used solely or as a mixture of them or as a mixed gas of the foregoing gas and nitrogen, helium, argon, etc. The concentration of the active gas in the activation gas is usually 5 to 100% by volume, preferably 20 to 90% by volume.

The activation treatment for the oxidized fibers is usually performed at higher than 700° C. but when obtaining ACF spun yarns, it is preferred to perform the activation in a short period of time at a temperature of 950° to 1,400° C. The particularly preferred activation temperature is 1,100° to 1,200° C.

The activation time depends upon the activation temperature, the kind of the activation medium, the kind of oxidized fibers, and kind and the content of additives to the fibers, such as a phosphorus compound, etc., and the extent of the activation of the ACF spun yarn produced but is usually from 10 seconds to 60 minutes.

The ACF in this invention is the fibers derived from acrylonitrile-based fibers by the foregoing method and is required to have such properties that the specific surface area thereof is 500 to 1,500 m$^2$/g, the ductility is at least 0.5%, and the surface tension is at least 10 kg/mm$^2$. If the specific surface area is less than 500 m$^2$/g, the adsorptive property of the ACF spun yarn obtained is insufficient, while if the specific surface area is over 1,500 m$^2$/g, the strength of the yarn is reduced, the formation of fluff caused by shortening of fibers is increased, and the workability of the yarn formed is also reduced. If the ductility is less than 0.5%, the ductility of the spun yarn is also reduced which increases the formation of fluff. Also, if the tensile strength is less than 10 kg/mm$^2$, the workability of the spun yarn is reduced, the formation of fluff is increased and the yarn is liable to break during fabrication.

The ACF spun yarn of this invention is composed of ACF filaments having the above-described properties and has a twist coefficient of 30 to 60, preferably 35 to 55 which is defined by the following equation:

$$\text{twist coefficient} = \frac{\text{twist number per meter}}{\sqrt{\text{metric count of spun yarn}}}$$

The ACF spun yarn of this invention is the spun yarn of single yarn or twin or more yarns. In the case of single yarn, the foregoing twist coefficient shows the twist coefficient of the yarn itself and in the case of twin or more yarns, the twist coefficient shows the coefficient of primary twist or first twist.

If the twist coefficient of the spun yarn is over 60, the strength of the yarn becomes higher. However, snarls are liable to occur to reduce the workability, while if the twist coefficient is less than 30, the strength of the yarn is greatly reduced and also clogging of yarn guides by ravelings is increased.

With the spun yarn comprised of two or more yarns, it is preferred that the ratio of the final twist to the first twist be 0.50 to 0.70.

The metric count number of the spun yarn is preferably not more than 80, more preferably not more than 40, and it may be 1.

In order to produce the ACF spun yarn of this invention, it is preferred to perform spinning of fibers in the state of oxidized fibers and, thereafter, activate the spun yarn of the oxidized fibers as will be described hereinafter.

It is necessary that the ACF spun yarn of this invention is composed of ACF derived from acrylonitrile-based fibers because the spun yarn has high strength and ductility, forms less fluff during working, and is excellent in workability as compared to yarns composed of ACF derived from rayon fibers or phenol resin fibers.

During the production of the ACF spun yarn of this invention, spinning of fibers may be performed in any state of acrylonitrile-based fibers, oxidized fibers, or ACF but it is preferred to perform spinning in the state of finishing the oxidation treatment of acrylonitrile-based fibers and then activate the spun yarn of the oxidized fibers.

When spinning of fibers is performed at the state of acrylonitrile-based fibers and then the spun yarn is oxidized and activated, the spun yarn is liable to become brittle. Also, when spinning of fibers is performed at the state of ACF after activation, short fibers are liable to form in the spinning step which reduces the yield in the spinning step. Further, the adsorptive property of the ACF spun yarn is liable to be reduced by a spinning oil.

There is no particular restriction on the spinning method but tow spinning, throstle spinning, worsted spinning, etc., are generally employed. From the view point of obtaining a spun yarn of high strength, tow spinning is optimum in the foregoing spinning methods.

The fiber length of ACF in the spun yarn of the present invention may be continuous or cut fiber have a bias-cut of 60 to 100 mm average fiber length and 130 to 170 maximum length and are crimped.

Then, the invention is described in more detail by the following example. However, the scope of the invention is not limited to the examples.

EXAMPLE 1

Production of spun yarn

A tow (filament of 1.5 deniers) of 300,000 deniers composed of fibers obtained from a copolymer of 94.0% by weight acrylonitrile and 6.0% by weight methyl methacrylate was subjected to an oxidation treatment in air at 230° C. for 2 hours and then at 250° C. for 2 hours under a tension so that the free shrinkage became 75 to 80% to provide oxidized fibers. The amount of bonded oxygen of the oxidized fibers was 17.9% and the core ratio thereof was 3.7%.

The oxidized fibers were subjected to roving and fine-spinning by means of a tow reactor to provide three kinds of spun yarns (twin yarns) of oxidized fibers having 1,750 deniers and each different twist coefficient as shown in the following table shown hereafter as No. 2 to No. 4. Each of the spun yarns was activated in an activation furnace under the conditions of the pressure in furnace of 0.005 kg/cm$^2$, an activation temperature of 1,100° C., and activation gas of $H_2O$ and $N_2$ (2/1 by volume ratio) to provide an ACF spun yarn (twin yarns). The filament constituting each of the ACF spun yarns thus obtained had a specific surface area of 1,000±50 m$^2$/g, a ductility of 1.4%, and a tensile strength of 47 kg/mm$^2$. In addition, the benzene adsorptive property thereof was 49% (by JIS K1474).

The ACF spun yarn thus obtained had twist coefficients of 30, 44, and 51, respectively, as shown in the following table as No. 2 to No. 4. For example, in the case of No. 2, at the twist coefficient of the oxidized fibers per meter of 208 and the metric count of 48, the twist coefficient of the ACF spun yarn was 30.

The twist coefficient per meter was the first twist number of the ACF twin yarns and in this case the ratio of the final twist to the first twist was 0.62.

For comparison, ACF spun yarns having twist coefficients of 22, 65, and 79, respectively, were prepared by following the foregoing method. Properties of spun yarns:

For each of the ACF spun yarns thus obtained, the properties were measured as follows.

(1) Tensile strength (g/densier) and ductility (%).

(2) Fluff formation rate.

Each ACF spun yarn (twin yarns) was passed between two urethane sponge sheets (each having a thickness of 10 mm, pressure between the sheets is 6.1 kg/cm$^2$, the length of the sponge contacting with the spun yarn is 32 mm) at a speed of 100 meters/hr., the weight of fluffs attached to the sponge sheets was measured, and the fluff formation rate was obtained by the following equation.

$$\text{fluff formation rate (\%)} = \frac{(a)}{(b)} \times 100$$

(a): Weight (g) of fluffs attached to the sponge.

(b): Weight (g) of the ACF spun yarn passed through the sponge sheets.

(3) End breakage number when making core yarn.

A core yarn was prepared from the ACF spun yarn (twin yarns) and a polyester yarn (300 deniers, tensile strength: 5 g/d) at yarn speed of 100 meters/min. and the end breakage number per 30 minutes during the preparation of the core yarn was determined.

(4) Adsorption equilibrium time.

In an adsorption tube 2 cm in diameter was packed 2 g of the ACF spun yarn to a layer height of 6 cm and the time required for reaching equilibrium with a benzene-containing air having a concentration of 5,000 ppm passed through the tube at a rate of 2 liters/min. was measured.

The results of measurements of the foregoing items are shown in the following table.

| No. | Twist Coeff. | Tensile Stregnth (g/d.) | Ductility (%) | Fluff Rate (%) | End Breakage No.* | Adsorption Equilibrium Time (min.) |
|---|---|---|---|---|---|---|
| 1 | 22 | 0.3 | 1.4 | 7.9 | 7 | 11 |
| 2 | 30 | 3.6 | 2.1 | 1.0 | 1 | 20 |
| 3 | 44 | 3.9 | 2.3 | 0.8 | 0 | 31 |
| 4 | 51 | 4.0 | 2.1 | 0.4 | 0 | 42 |
| 5 | 65 | 1.7 | 1.5 | 3.9 | 4 | 48 |
| 6 | 79 | 0.4 | 1.4 | broke** | 14 | 55 |

*End breakage number of core yarn at preparation thereof.
**The spun yarn broke during the test.
Nos. 2, 3, and 4: Samples of this invention.
Nos. 1, 5, and 6: Comparison samples.

As is clear from the above results, the ACF spun yarns of this invention have high strength and ductility, give less formation of fluff, cause almost no end breakage, are excellent in workability, and show good adsorbency.

Substantially the same results as disclosed above were obtained when the spun yarns comprising of one or more than two yarns were tested in the same manner as described above.

While the invention has been described in detail and with reference to specific embodiments thereof, it will be apparent to one skilled in the art that various changes and modifications can be made therein without departing from the spirit and scope thereof.

What is claimed is:

1. An activated carbon fiber spun yarn comprising activated carbon fibers having a specific surface area of 500 to 1,500 $m^2/g$, a ductility of at least 0.5%, and a tensile strength of at least 10 $kg/mm^2$ and derived from acrylonitrile-based fibers, said spun yarn having a twist coefficient of 30 to 60, wherein the twist coefficient is defined by the equation:

$$\text{twist coefficient} = \frac{\text{twist number per meter}}{\sqrt{\text{metric count of spun yarn}}}$$

2. An activated carbon fiber spun yarn as claimed in claim 1 wherein the acrylonitrile-based fibers are fibers of acrylonitrile polymer or a copolymer of acrylonitrile containing at least 60% by weight acrylonitrile.

3. An activated carbon fiber spun yarn as claimed in claim 1 wherein the size of the acrylonitrile-based fibers is 0.5 to 7 deniers.

4. An activated carbon fiber spun yarn as claimed in claim 1, wherein the spun yarn is comprised of two yarns and the ratio of the final twist to the first twist of the spun yarn is 0.5 to 0.7.

5. An activated carbon fiber spun yarn as claimed in claim 1, wherein the spun yarn is comprised of continuous activated carbon fibers.

6. An activated carbon fiber spun yarn as claimed in claim 1, wherein the spun yarn is comprised of activated carbon fibers which are bias-cut to an average fiber length of 60 to 100 mm and a maximum length of 130 to 170 mm and are crimped.

7. An activated carbon fiber spun yarn as claimed in claim 1, wherein the specific surface area is in the range of 700 to 1,400 $m^2/g$.

8. An activated carbon fiber spun yarn as claimed in claim 1, wherein the ductility is at least 1%.

9. An activated carbon fiber spun yarn as claimed in claim 1, wherein the tensile strength is at least 20 $kg/mm^2$.

10. An activated carbon fiber spun yarn as claimed in claim 3, wherein the acrylonitrile-based fibers have a size in the range of 0.7 to 3 deniers.

11. An activated carbon fiber spun yarn as claimed in claim 2, wherein the actylonitrile-based fibers are fibers of acrylonitrile copolymer containing 80% to 98% by weight acrylonitrile.

12. An activated carbon fiber spun yarn as claimed in claim 1, wherein the spun yarn has a metric count number of 80 or less.

13. An activated carbon fiber spun yarn as claimed in claim 12, wherein the twist coefficient is in the range of 35 to 55 and wherein the metric count number is 40 or less.

14. An activated carbon fiber spun yarn as claimed in claim 1, wherein the activated carbon fibers are obtained from oxidized fibers derived from acrylonitrile based fibers and said oxidized fibers have a core ratio of less than 18%.

* * * * *